United States Patent [19]

Chavez

[11] 4,437,661

[45] Mar. 20, 1984

[54] FOOTBALL KICKING TRAINER TOY

[76] Inventor: John P. Chavez, 1522 S. Lamar St., Lakewood, Colo. 80226

[21] Appl. No.: 256,012

[22] Filed: Apr. 21, 1981

[51] Int. Cl.[3] ..... A63B 67/00

[52] U.S. Cl. ..... 273/55 R; 273/55 D

[58] Field of Search ..... 273/55 B, 55 D, 58 B, 273/65 EE, 30, 29 R, 29 A, 26 R, 26 A; 272/78

[56] References Cited

U.S. PATENT DOCUMENTS

| | | | |
|---|---|---|---|
| 648,512 | 5/1900 | Manley | 273/55 D |
| 2,076,911 | 4/1937 | Monson | 273/55 D |
| 3,408,071 | 10/1968 | Lundy | 273/26 A |
| 3,563,544 | 2/1971 | Hedrick | 273/29 A |
| 3,675,922 | 7/1972 | Nieland | 273/55 B |
| 3,820,787 | 6/1974 | Heinbigner | 273/55 B |
| 3,825,261 | 7/1974 | Zapas | 273/55 D |
| 4,068,846 | 1/1978 | Forrest | 273/55 B |

FOREIGN PATENT DOCUMENTS

| | | | |
|---|---|---|---|
| 1325472 | 3/1963 | France | 272/78 |
| 473665 | 4/1937 | United Kingdom | 273/30 |

OTHER PUBLICATIONS

COSOM: Div. of ITT, p. 41.

*Primary Examiner*—Richard C. Pinkham
*Assistant Examiner*—T. Brown
*Attorney, Agent, or Firm*—Kyle W. Rost

[57] ABSTRACT

A reduced-scale football goal post is provided with a broad support base carrying a standard that, in turn, supports in offset position from the standard a U shaped frame formed from a cross-bar and pair of spaced apart upright arms. A pivoted arm near the top of each upright arm is attached to a backdrop or net that extends downwardly to at least the level of the base and is weighted along its bottom edge by a ballast. The forward offset of the U shaped frame assists in resisting the rearward tipping of the trainer if struck by the football, and the corresponding rearward protrusion of the standard spaces the net from the rear of the U shaped frame to provide depth and a reception area at the back of the frame.

2 Claims, 4 Drawing Figures

FOOTBALL KICKING TRAINER TOY

BACKGROUND OF THE INVENTION

1. Field of the Invention

The invention relates to amusement devices and games. More specifically, the invention relates to football in the area of kicking tees and kicking trainers.

2. Description of the Prior Art

Football kicking trainers are known primarily as practice aids used with standard size and weight footballs. Related devices are known for catching other types of balls such as golf balls. The general structure of such ball-catching trainers has included a strong frame and a ground anchor to hold the frame in place against the force of the practice ball. U.S. Pat. No. 4,068,846 to Forrest teaches such a football kicking trainer wherein a frame supported net includes a target area having a simulated cross-bar and uprights with adjustable width of the target area.

Although ball-catching trainers function adequately for their intended purposes, their use has been largely limited to skilled athletes since the trainers are relatively costly because of heavy construction. Trainers for football kicking practice have provided target areas, as with the above noted patent, but have not simulated an actual goal post since this type of structure is unnecessary for use by skilled athletes.

Particularly in the case of football kicking trainers, there has been no adequate provision for indoor use, reflecting the basic outdoor nature of the game in terms of space required and relatively high force applied to the kicked ball. Typical indoor home space limitations make the use of prior known kicking trainers inadvisable, and the lack of suitable means of fastening such a trainer to the floor in a home also tends to discourage its use.

For the above noted reasons, football kicking trainers have not previously been suited for use as indoor toys.

SUMMARY OF THE INVENTION

A football kicking trainer is adapted for recreational use, especially as a children's recreational toy, in combination with a light weight football such as a foam plastic football of sponge-like composition. The trainer simulates the appearance of a professional football goal post, but the configuration is adapted to be used either indoors or outdoors without the necessity of anchoring the trainer to the ground or floor.

The trainer is constructed from a base that carries an upright standard. Near the top of the standard, a support arm extends to the side of the standard and carries a U shaped frame that defines the kicking target. The offset position of the frame by its mounting on the support arm biases the center of mass of the kicking target to the forward side of the base and provides stability to the trainer that reduces the chance of tipping if a part of the frame is struck by the kicked football. The composition of the trainer is nevertheless very light in weight and inexpensive in material, with substantially all parts being constructed from plastic tubing. The base may be relatively heavy or may define an interior cavity that can be filled with ballast material to further improve stability.

A flexible impact damping device such as a net or drape is carried behind the U shaped frame to receive the football. The drape is anchorable at base level by ballast placed in ballast pockets along the bottom edge of the drape, permitting the drape to be effective to stop balls even at ground level without requiring fixed attachment to the ground or floor and without requiring a framework that would be incongruous with the desired resemblence to a professional goal post.

The pair of upright arms defining the sides of the U shaped frame may each carry a pivoted arm near its top end. The arms are mounted to pivot on arcs normal to the plane of the frame, and the impact damping device may be attached to the arms so that it can be raised and lowered according to the needs of the kicker and, if the trainer is used indoors, according to the space available below the ceiling. The impact damping device may hang below the pivoted arms on the side of the frame opposite from the direction in which the support arm extends from the standard, whereby the standard assists in maintaining the impact damping device at a spaced distance behind the U shaped frame to provide depth to the kicking target area, to permit the ball to fall behind the U shaped frame in realistic fashion, and to thereby establish an easily recognized difference between the front and rear of the trainer so that the offset of the frame is properly directed toward the kicker.

An object of the invention is to provide an inexpensive, relatively light weight recreational kicking trainer especially suited for use with sponge-like toy footballs, wherein the trainer is capable of being used either indoors or outdoors without being staked or anchored to the ground or floor.

Another object is to provide a free-standing kicking trainer that resists tipping when struck by a kicked toy football, while at the same time the trainer avoids the need for braces or other supports that would substantially disrupt the visual resemblence between the trainer and a traditional goal post.

A further object is to provide a backdrop for stopping kicked balls, wherein the backdrop is self-contained with the trainer and is adjustable in height and relative position for use either indoors or outdoors.

Still another object is to provide a spacing between the backdrop and U shaped frame regardless of the adjustment of the backdrop so that the frame area has depth and the light weight football will fall behind the frame without having to substantially displace the backdrop.

DESCRIPTION OF THE PREFERRED EMBODIMENT

Figure 1:
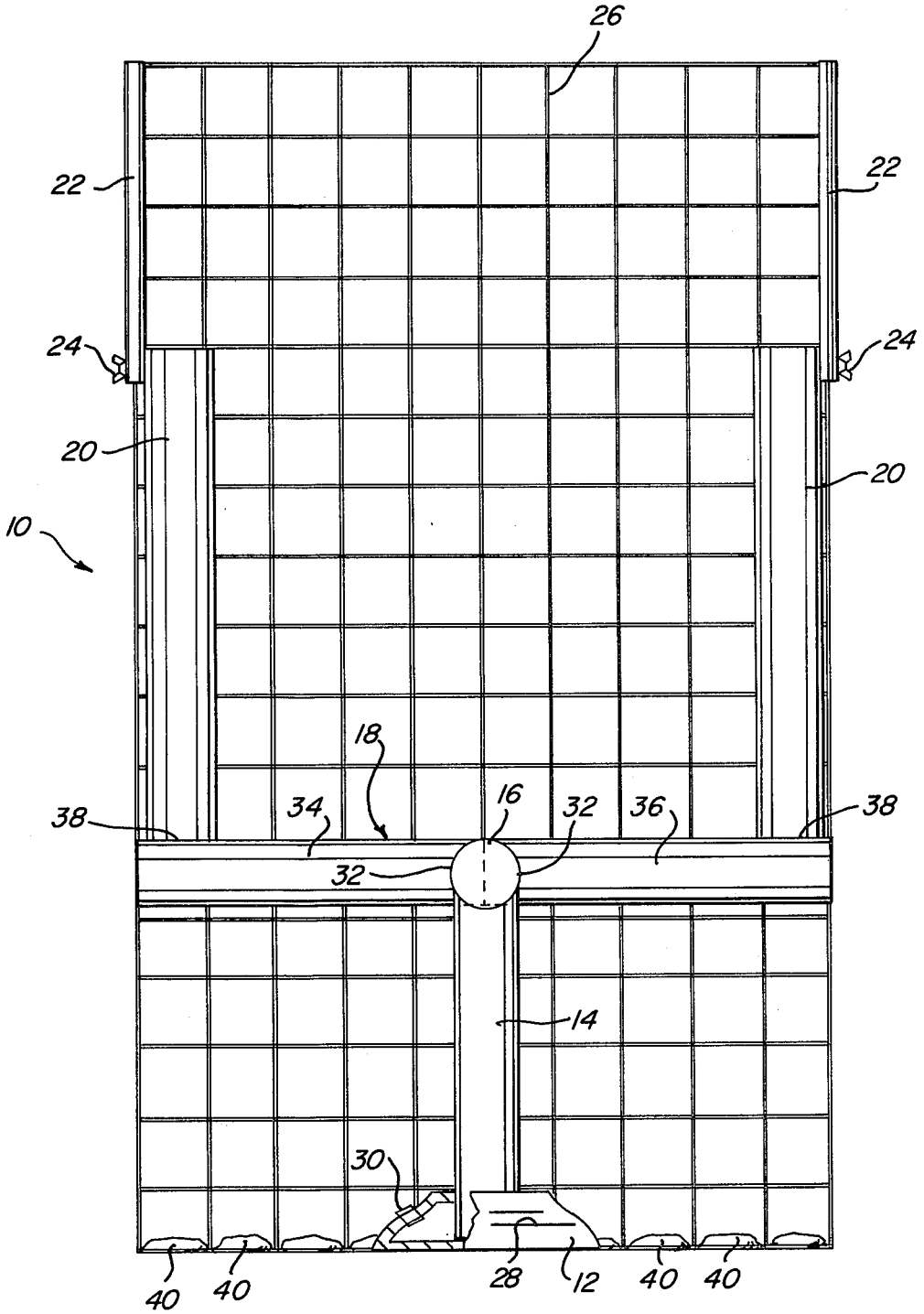
FIG. 1 is a front elevational view of the kicking trainer.
Figure 2:
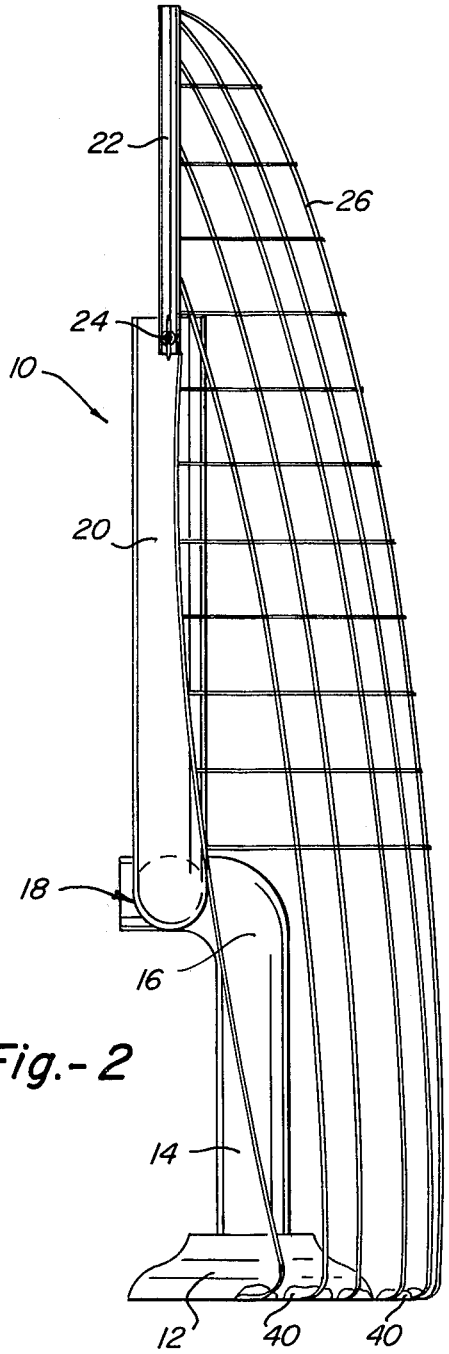
FIG. 2 is a side elevational view thereof.

The football kicking trainer 10 is best shown in FIGS. 1 and 2 to include a base 12 connected to a standard 14 that extends upwardly from the base and is connected near its upper end to a support arm 16 extending laterally of the standard. The support arm is connected to a cross-bar 18 at a position horizontally offset from the center of the standard, and the cross-bar lies substantially in a horizontal plane. A spaced apart pair of uprights 20 are attached near the opposite ends of the cross-bar and extend upwardly therefrom to define, in combination with the cross-bar, a U shaped frame. Each upright is associated with a pivoted arm 22 joined near the upper end of the upright and secured by a releasable fastener 24. A flexible impact damping means 26 for receiving the force of a football passing through the U shaped frame is carried on the back side of the trainer.

The base provides substantially all support necessary to maintain the trainer in upright position. In the drawings, the base is shown to be circular with a greater width than height so that the shape of the base does not overly disrupt the resemblence of the trainer to a goal post of the type mounted in the ground. In its top center, the base may define a recessed socket 28 for receipt of the lower end of the standard, or other suitable connecting means may be used to assure a firm junction between the base and standard. The base may be formed from a heavy material such as iron; but it is preferred that the base be of light weight material such as plastic, in which case the base may have an interior cavity that can be filled with sand or fine rock to provide ballast. A closure 30 may be provided on the base to permit ballast to be inserted, or the socket 28 may be in communication with the cavity for the same purpose.

Standard 14 extends upwardly from the base, following an approximately vertical axis. Near the top of the standard, a separate support arm 16 may be attached, or the standard itself may define the support arm 16 as a continuous extension of the standard. The support arm deviates from the vertical axis of the standard, extending laterally from the standard axis. The support arm may angle normally to the standard axis. The direction in which the support arm deviates from the standard axis may be termed the front side of the trainer. The purpose of the support arm 16 is to carry the remainder of the trainer at a point horizontally offset from the vertical axis of the standard, as well as to simulate the appearance of a traditional goal post. The support arm therefore is adapted to carry the cross-bar near the end furthest offset from the standard axis. A pair of apertures may therefore be defined along a horizontal axis transverse to the direction in which the support arm extends from the standard. The apertures provide an attachment means for connection of the support arm to either a one piece cross-bar or a two piece cross-bar.

Cross-bar 18 is engaged in the apertures 32 and thereby held in a horizontal position offset from the standard to the front side of the trainer. Cross-bar half portions 34 and 36 may each be received in a separate aperture 32 and extend in opposite directions from the support arm; or the apertures may be connected by a continuous bore across the support arm, thereby permitting the cross-bar portions to further be engaged with each other near the center of the bore length. The opposite ends of the cross-bar are provided with connecting means for attachment of uprights 20. Suitable connecting means for this purpose may include sockets 38 adapted to receive the lower ends of the uprights.

Figure 3:
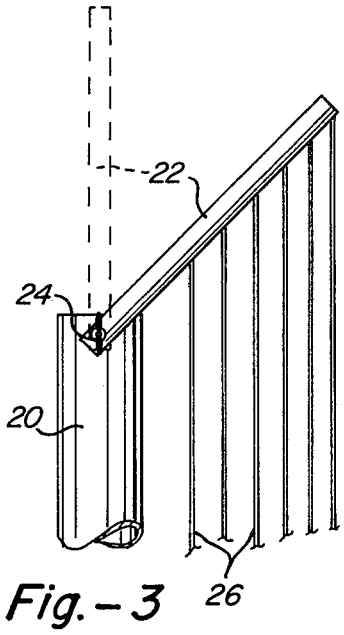
FIG. 3 is a fragmentary view of an upright arm and its associated pivoted arm, showing an alternate position of the pivoted arm in phantom.
Figure 4:
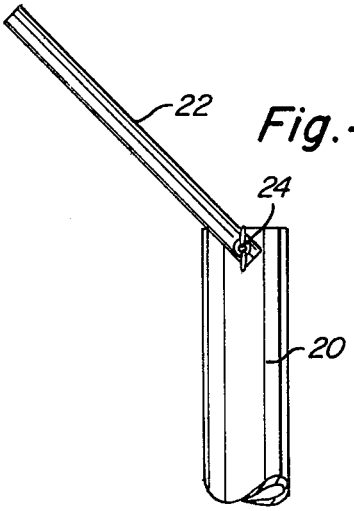
FIG. 4 is a fragmentary view similar to FIG. 3, showing still another position of the pivoted arm.

The cross-bar and uprights together define a U shaped frame having the uprights 20 in substantially vertical orientation, with the entire frame lying in a single vertical plane offset to the front side of the trainer from the standard. A football passing through the frame is stopped by an impact damping means supported on the rear side of the frame. The attachment between the frame and the damping means may be via pivoted arms 22. The pivot axis of each arm 22 may be defined by the releasable fastener 24 to be parallel to the vertical plane of the frame. Thus, the pivoted arms are movable through an arc lying in a vertical plane normal to the plane of the frame. The pivoted arms may be positioned in a variety of ways, depending upon the requirements of the user. In FIG. 3, the arm is shown in full vertical position in the phantom drawing, wherein the illustrated net 26 is extended to its maximum height. The solid lined portion of the drawing shows the arms at an acute rearward angle, holding the net at a spaced distance from the rear side of the U shaped frame. FIG. 4 shows the arms at an acute forward angle, wherein the net 26 is partially over the top of the frame. The fastener 24, which may be a wing nut on a threaded shaft, permits any such position to be selected.

The net or other suitable damping means may be attached exclusively to the pivoted arms so that the arms may be positioned as desired without distorting the net shape. The bottom edge of the damping means may be weighted by a ballast means such as bean bags 40 holding the lower net edge against the underlying surface without physical connection to the base other than through the length of the net. It is therefore possible to place the bottom of the net at any of a variety of positions to prevent the football from passing.

In use, the trainer is intended to receive soft, light weight toy footballs of the type constructed from sponge-like materials such as foam plastic or rubber. The net 26 may be tilted to the forward position to catch such footballs during indoor use, when a light fixture or ceiling may require protection. For outdoor use, it may be more desirable to have the pivoted arms in full vertical position to stop high kicks, or in a rearwardly angled position to space the net behind the U shaped frame. Regardless of the position of the pivoted arms, the net is automatically held at a rearwardly spaced position from the U shaped frame by the standard 14 and rear portion of the support arm 16 that are rearward of the frame. This provides an appearance of depth in the frame and permits the football, after striking the net, to drop behind the cross-bar in realistic fashion, despite the very light weight of such footballs and the expected difficulty such footballs would have in displacing a net. The net spacing behind the frame may be further increased by moving the ballast means 40 to the rear.

The construction of the kicking trainer is substantially entirely from plastic tubing, other than for the base as described previously. The standard, cross-bar, and uprights may all be formed from such tubing with a wall thickness of, for example, one-eighth inch. The standard may be approximately three feet long, including the support arm, and formed from three inch diameter tube. The cross-bar may be five feet long and formed from two and one-half inch diameter tubing, with the five foot length divided into substantially equal halves. The uprights may be three and one-half feet in length and two inches in diameter. These members may be assembled by a snug fit in sockets as previously described. The pivot arms may be constructed from metal bars so as to be visually less noticeable. Such bars may be two feet long, one-half inch wide, and one-eighth inch thick. Base 12 may have a diameter of twenty inches. A kicking trainer of this construction is relatively light in weight, inexpensive to construct, and easy to move. It is therefore suited for use as a toy while providing many of the visual associations of a full size traditional goal post.

The above description is intended to be by way of example and not limitation. The scope of the invention is therefore to be limited only by the following claims.

What is claimed is:

1. An improved football kicking trainer employing a goalpost of the type having a base adapted to rest upon an underlying surface, a standard connected to the base and extending upwardly therefrom, a support arm extending laterally of the standard and connected to the standard near the upper end of the standard, a cross-bar connected centrally to the support arm and extending transversely to the standard and to the support arm in a substantially horizontal plane and offset laterally from the standard, and a pair of upright bars attached near opposite ends of the cross-bar and extending upwardly therefrom in substantially independent relationship to define in combination with the cross-bar a U shaped frame in a substantially vertical plane through the cross-bar; and employing a flexible impact damping means for receiving the force of a light weight football when, in use, such a football is directed through the U shaped frame, wherein the improvement comprises: each upright having attached at its upper end a pivoted extension arm extendable upward and in a direction rearward of said goal post, said impact damping means being suspended from each said extension arm substantially solely under force of gravity on the side of the U shaped frame opposite from the direction of lateral extension of the support arm from the standard such that the impact damping means is spaced apart from the cross-bar by at least the length of said support arm for creating a horizontal ball reception area between the cross-bar and impact damping means.

2. The football kicking trainer of claim 1, wherein said impact damping means extends vertically at least from the top of said extension arms to the base, and further comprises ballast means connected directly to the impact damping means near the level of the base for weighting the impact damping means against, in use, an underlying surface and for variable positioning of the impact damping means under gravity, with respect to the goalpost position.

* * * * *